US007004893B1

(12) United States Patent
Waters

(10) Patent No.: US 7,004,893 B1
(45) **Date of Patent: *Feb. 28, 2006**

(54) PORTABLE EXERCISE APPARATUS FOR SIT-UP EXERCISE

(76) Inventor: Anthony Waters, 1031 NW. 106 St., Miami, FL (US) 33150

( * ) Notice: Subject to any disclaimer, the term of this patent is extended or adjusted under 35 U.S.C. 154(b) by 30 days.

This patent is subject to a terminal disclaimer.

(21) Appl. No.: 10/228,930

(22) Filed: Aug. 27, 2002

Related U.S. Application Data

(63) Continuation-in-part of application No. 09/362,222, filed on Jul. 28, 1999, now Pat. No. 6,447,434.

(51) Int. Cl.
*A63B 21/00* (2006.01)

(52) U.S. Cl. ..... 482/140; 482/51; 482/52

(58) Field of Classification Search ..... 482/51, 482/52, 126, 121, 129, 124, 907, 904, 140, 482/130, 148, 72
See application file for complete search history.

(56) References Cited

U.S. PATENT DOCUMENTS 557,935 A * 4/1896 Pustaver et al. ..... 294/5
565,368 A * 8/1896 Wilkinson ..... 16/220
2,097,376 A * 10/1937 Marshman ..... 482/124
4,582,319 A * 4/1986 Luna ..... 482/130
5,820,533 A * 10/1998 Goldman ..... 482/124
5,941,799 A * 8/1999 Bergdorf ..... 482/44

* cited by examiner

*Primary Examiner*—Jerome W. Donnelly

(57) ABSTRACT

A portable exercise apparatus assisting one person to do sit-up exercise is provided, which includes a footrest, a harness, a resilient retraction means connected between the footrest and harness, and an anchoring means for anchoring the footrest to a stationary support. In use, a person wears the harness connected with the resilient retraction means which connects to the footrest, and seats on the floor with his feet against the footrest. With the assistance of the apparatus, the exerciser alternates between backward prone and sitting upright positions to do sit-up exercise. Another portable exercise apparatus assisting two persons to do sit-up exercise is also provided, which includes a footrest and a hand-pulling device. In use, each person is seated on opposite sides of the footrest, with their feet against the footrest. Each person grips one handle of the hand-pulling device and alternates between sitting upright and backward prone positions.

18 Claims, 8 Drawing Sheets

PORTABLE EXERCISE APPARATUS FOR SIT-UP EXERCISE

This application is a Continuation-In-Part of Non-Provisional patent application Ser. No. 09/362,222, filed Jul. 28, 1999 now U.S. Pat. No. 6,447,434.

FIELD OF THE INVENTION

The present invention relates to exercise equipment and, more particularly, to two portable exercise apparatuses which assist one and two person to perform sit-up exercise, respectively.

BACKGROUND OF THE INVENTION

Sit-up exercise is a common exercise for building abdominal muscles. It is particularly used for sports and military personnel trainings. It is an exercise that can be performed conveniently without equipment, and space requirement. However, for many people, particularly women, it is very difficult to do sit-up on their own because of weak muscles, or lack of routine exercises. Such a difficulty not only turns these people further away from performing the exercise, but also increases the possibility of body injuries.

Over the past several years, numerous types of exercise equipment have been developed. Such prior art equipment typically provides means for an individual to perform one or more physical exercises for body tone, muscle building, heart conditioning, lung development and other like purposes. Many of these prior art devices are large, bulky and cumbersome and, consequently, generally stationary equipment. Necessarily, then, such devices take up a fair amount of space and are not suitable for persons without extra space in their home or office. Moreover, such devices are not suitable for persons desiring to use the equipment in more than one location.

On the other hand, various types of small portable equipment specifically used for building abdominal muscles have been developed recently. Examples include xx, and xx. However, these portable equipments are not designed for assisting people in performing sit-up exercise.

Accordingly, there is a need for portable exercise equipment which can assist people in performing sit-up exercise. It is desirable to have such equipment to be lightweight, compact, inexpensive and easy to operate and transport. The present invention is particularly suited to address this need in a manner not previously contemplated.

SUMMARY OF THE INVENTION

In one embodiment, the present invention provides a portable exercise apparatus for assisting two person to do sit-up exercise together. The apparatus comprises a hand-pulling device and footrest. The hand-pulling device comprises a pair of handles connected by an adjustable connector, handles being in perpendicular relation to a longitudinal axis of the adjustable connector. The footrest has a pair of longitudinally disposed sidewalls for supporting feet of exercisers, and a pair of opposing endwalls. The hand-pulling device is removably attached to the footrest for storage and transportation.

In the second embodiment, the present invention provides another portable exercise apparatus for assisting one person to do sit-up exercise. The apparatus comprises a footrest, a harness for a human upper body, a resilient retraction means connected between the footrest and the harness, and an anchoring means for anchoring the footrest to a stationary support.

The present invention also provides a method of physical exercise, which comprises the steps of: anchoring a footrest to a solid support; wearing a harness on the upper body of an exerciser; connecting a resilient retraction means between the footrest and the harness; and the exerciser sitting in front of the footrest, placing the exerciser's feet against the footrest, and alternating between a sitting upright position and a backward prone position.

BRIEF DESCRIPTION OF THE DRAWINGS

The above and other objects, features and other advantages of the present invention will be more clearly understood from the following detailed description taken in conjunction with the accompanying drawings, in which.

Like reference numerals refer to like parts throughout the several views of the drawings.

DETAILED DESCRIPTION OF THE INVENTION

Figure 1A:
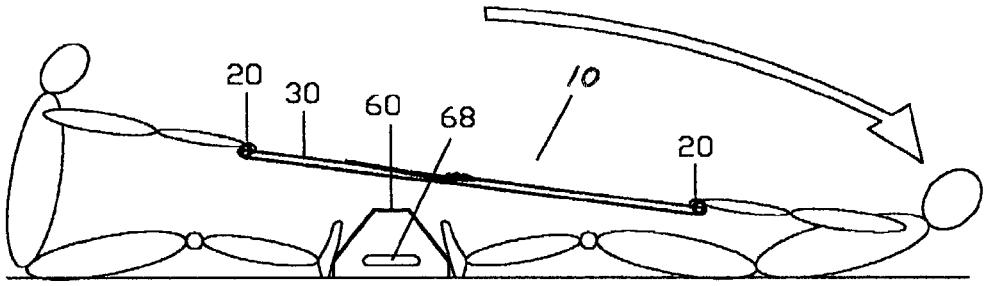
FIG. 1A illustrates the use of the portable exercise apparatus of the first embodiment of the present invention showing a first person in the prone position and the second person in the sitting position.
Figure 1B:
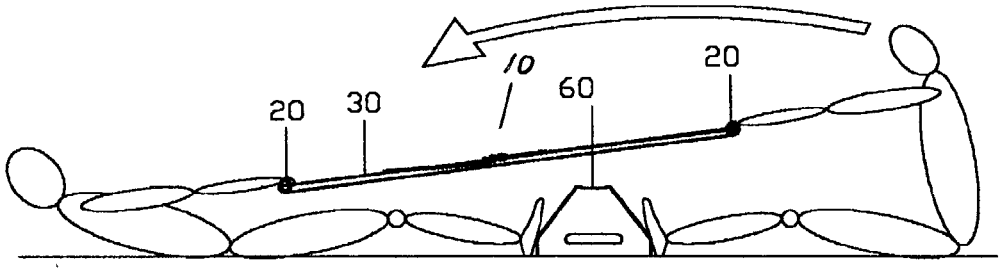
FIG. 1B illustrates the use of the portable exercise apparatus of the first embodiment of the present invention showing a second person in the prone position and the first person in the sitting position.

In the first embodiment, the present invention is directed to a portable exercise apparatus which enables two persons to perform a sit-up exercise together as shown in FIGS. 1A and 1B.

Referring to FIGS. 1A, 1B, and 2 to 5, the portable exercise apparatus comprises a hand-pulling device 10 comprising a pair of handles 20 connected by an adjustable connector 30, and a footrest 60. The handles 20 are in perpendicular relation to a longitudinal axis of adjustable connector 30.

Figure 2:
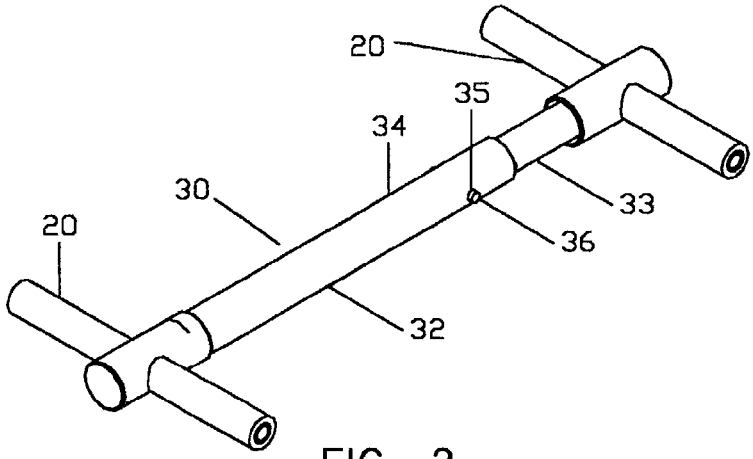
FIG. 2 is a perspective view of an elongated bar as the adjustable connector of the hand-pulling device of the first embodiment.

FIG. 2 shows one type of hand-pulling device 10, wherein adjustable connector 30 is an elongated bar 32. The elongated bar 32 includes an inner tubular member 33 and an outer tubular member 34 arranged telescopically. Adjustment holes 35 are provided along the length of the inner 33 and outer 34 tubular members so as to allow the users to adjust the length of elongated bar 32 to accommodate the particular height and reach of the exercisers. An outwardly biased pin 36 disposed within the inner member 33 retains the inner 33 and outer 34 members in place relative to one another. A pair of tubular-shaped handles 20 are connected to the two ends of elongated bar 32 to provide a means for gripping elongated bar 32. Foam or rubber gripping surfaces may be provided over the handle 20 to facilitate gripping.

Figure 3:
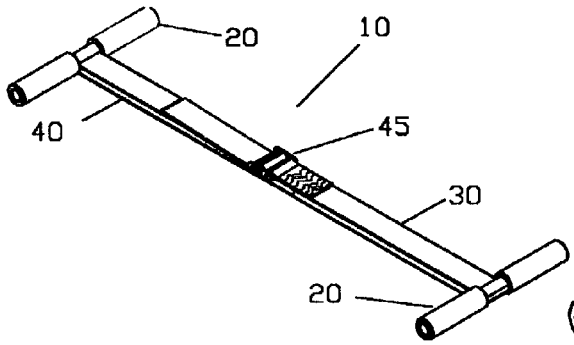
FIG. 3 is a perspective view of an adjustable belt as the adjustable connector of the hand-pulling device of the first embodiment.
Figure 4:
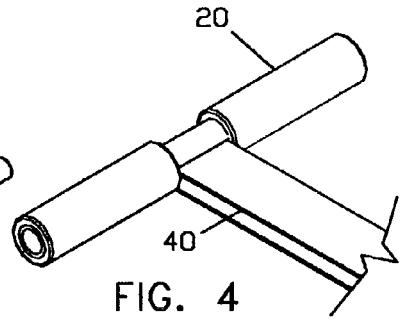
FIG. 4 is a perspective view of the handle portion of FIG. 3.

FIGS. 3 and 4 show another type of hand-pulling device 10, wherein adjustable connector 30 is a belt 40 connected with a belt length adjusting means 46. The belt 40 can be connected to the pair of handles 20 by wrapping around handle 20. FIG. 4 shows one example of connection between handle 20 and belt 40, wherein belt 40 is inserted through two molded-in slots in handle 20. Other suitable connections, such as inserting through one slot in handle 20, or connecting through an additional connection means linked to handle 20, are also feasible for the purpose of the present invention.

Figure 5A:
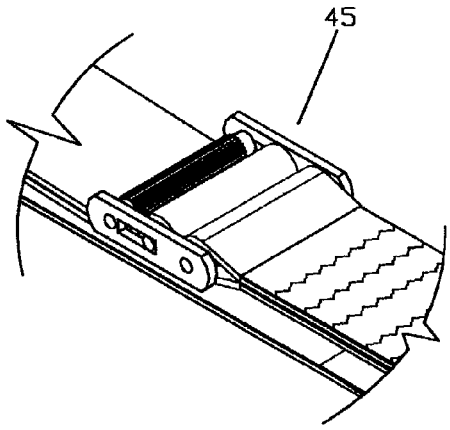
FIG. 5A is a perspective view of a belt length adjusting means of the first embodiment of the present invention.
Figure 5B:
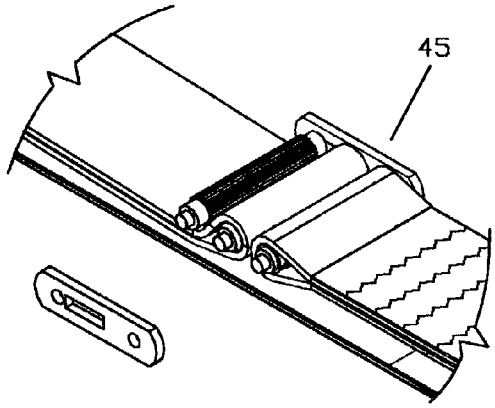
FIG. 5B is an exploded view of a belt length adjusting means of the first embodiment of the present invention.

FIGS. 5A and 5B show one example of belt length adjusting means 45, which is a belt buckle used commonly for luggage belt. Other types of belt buckles, and/or locking mechanism such as locking loops, can also be used for the purpose of the present invention.

Figure 6:
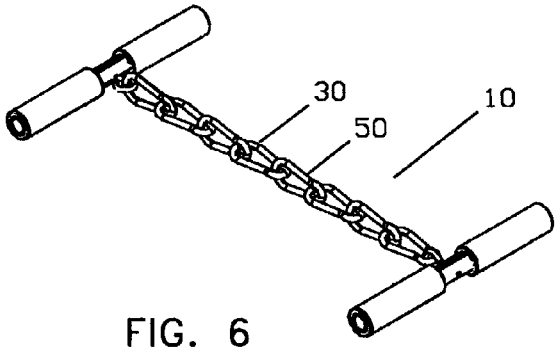
FIG. 6 is a perspective view of linked locking loops as the adjustable connector of the hand-pulling device of the first embodiment.

FIG. 6 shows yet another type of hand-pulling device 10, wherein adjustable connector 30 is a plurality of linked locking loops 50. The length of adjustable connector 30 in this embodiment can simply be adjusted by adding or taking out certain numbers of locking loops 50.

Figure 7:
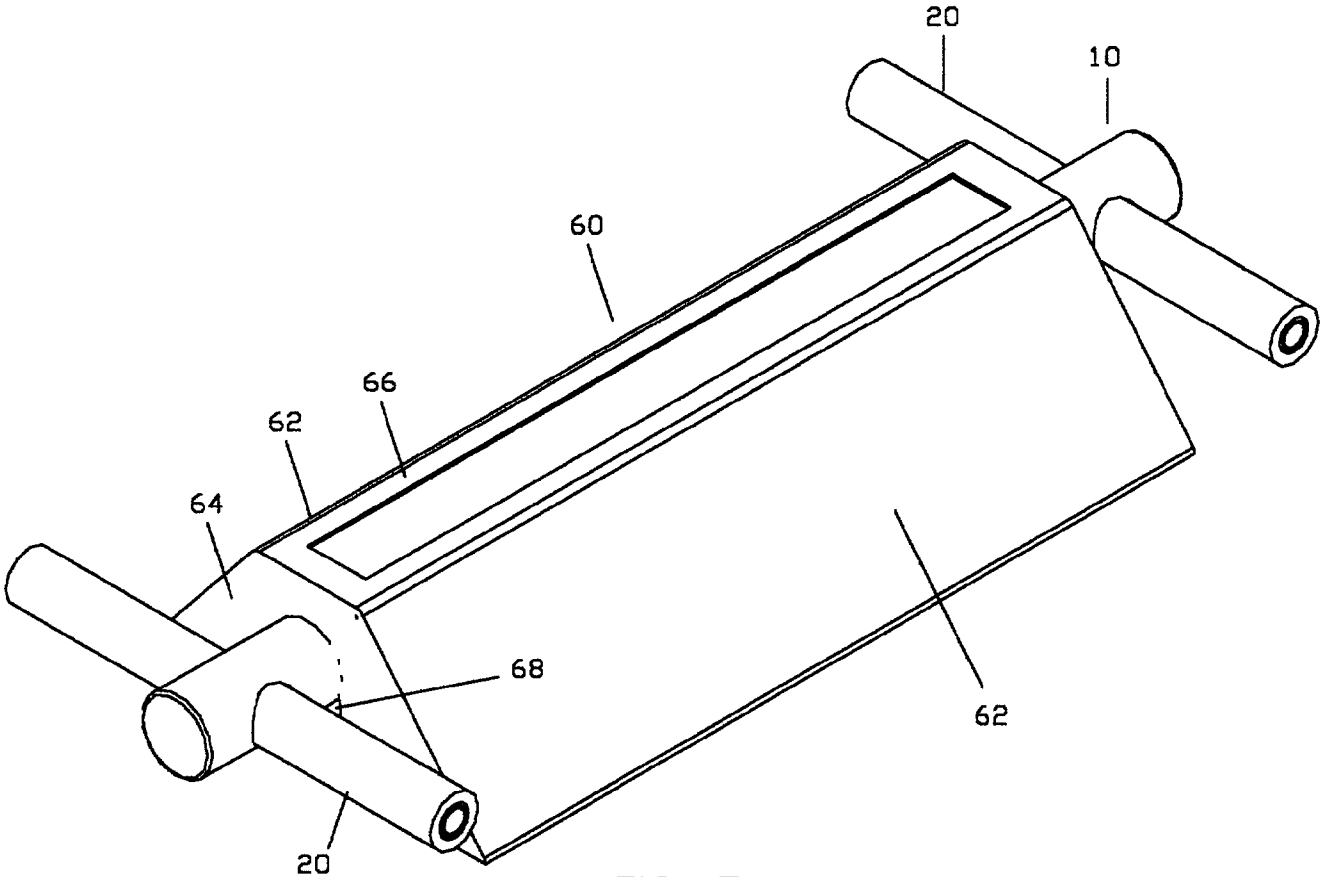
FIG. 7 is a perspective view of the footrest with the hand-pulling device attached within the footrest for transportation or storage.

FIG. 7 shows one example of footrest 60 of the first embodiment of the present invention. The footrest 60 has a pair of longitudinally disposed sidewalls 62 for supporting feet of exercisers, and a pair of opposing endwalls 64. Sidewalls 62 project downwards and outward from a top 66 which connects sidewalls 62. The footrest 60 can further include a disposing opening 68 on each of endwalls 64, so that elongated bar 32 can be removably attached to footrest 60 for storage and transportation as shown in FIG. 7. In FIGS. 1A and 1B, disposing opening 68 is a slot on sidewall 64, through which belt 40 or locking loop 50 can be attached to footrest 60. Furthermore, disposing opening 68 also functions as a handle of footrest 60 for positioning footrest 60 by a user.

The footrest 60 is structured to rest flat on a floor and is preferably constructed of a molded plastic of a one-piece construction. However, the footrest 60 can, alternatively, be constructed of any other suitable material. Reinforcing ribs can be appropriately located within the hollow interior of footrest 60 to provide further supports to the structure. The inclined sidewalls 62 can be provided with striations parallel to the length of footrest 60 to provide a slip-free surface. The outer surface of sidewalls 62 can additionally or alternatively be coated with a rubber-like, non-skid substance to further aid in providing a slip-free surface. The surface of the bottom edges of footrest 60 can be made non-skid to assist stabilization of footrest 60 during the exercise. Preferably, two long molding strips made of a resilient material are attached to the bottom edges of side walls 62 of footrest 60 to prevent skid.

In use as illustrated in FIGS. 1A and 1B, each person is seated on the opposite sides of footrest 60, facing each other, with their feet up against inclined sidewalls 62. The hand-pulling device 10 is adjusted in length to approximate the distance between the extended arms of the two people when one is-lying prone on his back and the other is sitting upright. With each person gripping handle 20 on their respective end of hand-pulling device 10, the person sitting up reclines backward towards the prone position while pulling the other person upward to an upright sitting position. At the same time, the person who was initially reclining backwards utilizes his abdominal muscles to sit up. This process is repeated back and forth until the desired number of repetitions are completed.

Although the exercise apparatus of the present invention is mainly used for the sit-up exercise, it can also be used for stretching muscles. When the apparatus is used for the purpose of stretching, the first person bends downs and holds his head between arms, and the second person pulls the hand-pulling device to stretch the first person. The location of the muscle being affected can be controlled by the distance between the two persons. The distance can be controlled either by adjusting the length of the hand-pulling device or by controlling position of the first person's legs. When the first person's legs are straight against the footrest, the stretch can affect the muscles of the first person's legs. However, when the first person's legs are slightly bent, the stretch affects the muscles around the first person's back and shoulders.

Figure 8A:
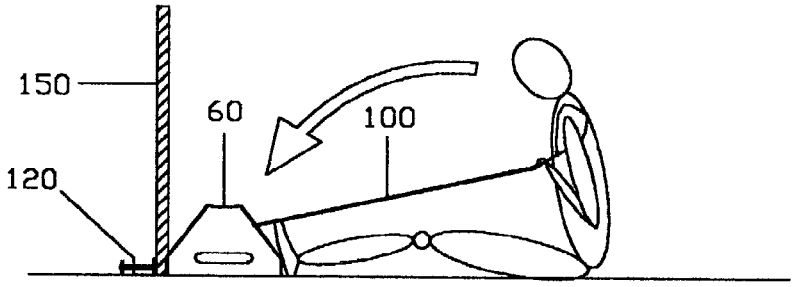
FIG. 8A illustrates the use of the portable exercise apparatus of the second embodiment of the present invention showing an exerciser in a sitting upright position.
Figure 8B:
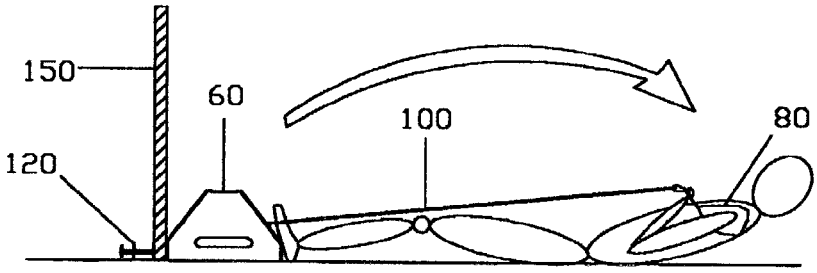
FIG. 8B illustrates the use of the portable exercise apparatus of the second embodiment of the present invention showing an exerciser in a reclined prone backward position.

In the second embodiment, the present invention is directed to another portable exercise apparatus which assists one person to perform a sit-up exercise as shown in FIGS. 8A and 8B.

In this embodiment, the portable exercise apparatus comprises a footrest 60, a harness 80 for a human upper body, a resilient retraction means 100 connected between footrest 60 and harness 80, and an anchoring means 120 for anchoring footrest 60 to a stationary support 150.

Figure 9A:
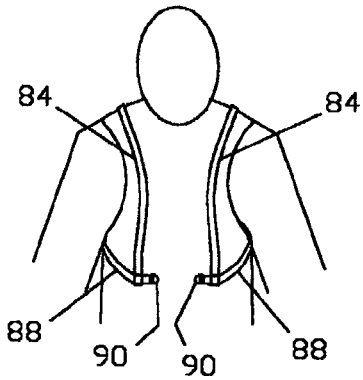
FIG. 9A illustrates the front of the harness of the second embodiment on an exercisers' body.
Figure 9B:
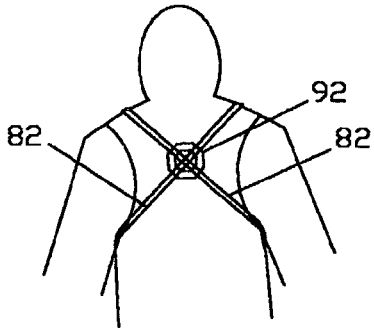
FIG. 9B illustrates the back of the harness of the second embodiment on an exercisers' body.
Figure 10:
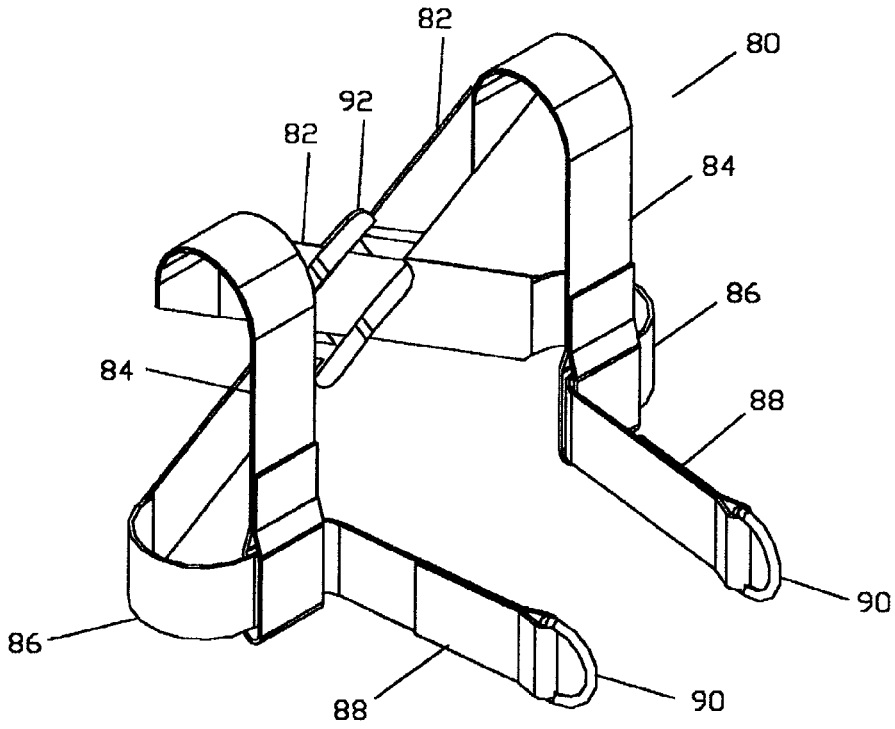
FIG. 10 is a perspective view of the harness of the second embodiment of the present invention.
Figure 11:
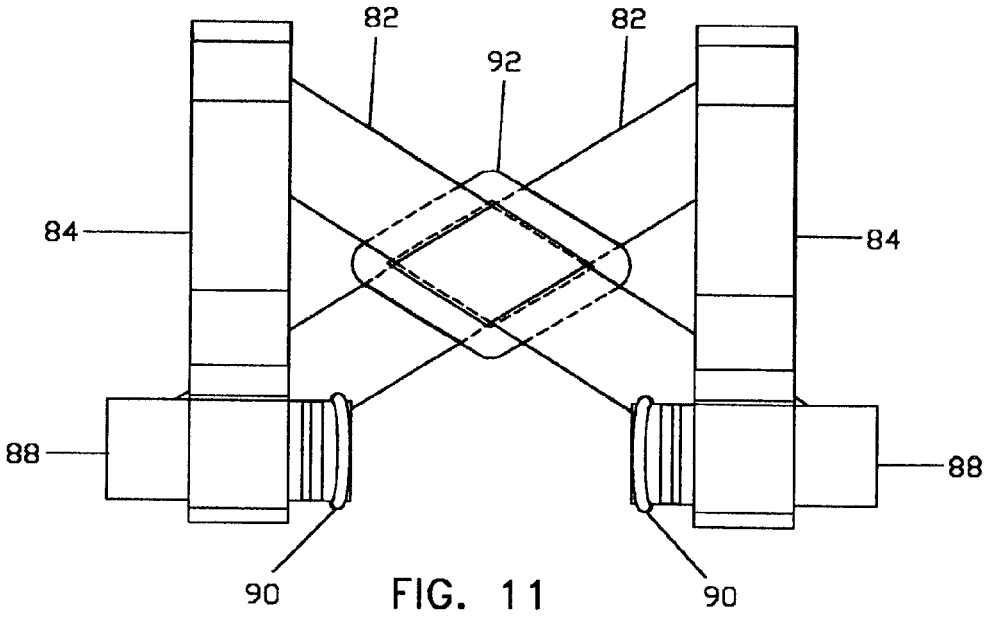
FIG. 11 is a front view of the harness of the second embodiment of the present invention.

FIGS. 9A and 9B show the front and back of a harness 80 wore by an exerciser. As shown in FIGS. 10 and 11, harness 80 has two back straps 82, each with an upper end extending to a front vertical strap 84 and with a lower end connected to a horizontal strap 86. Each horizontal strap 86 is connected to a front extension 88 which is connected a retraction connection means 90. Each of front vertical straps 84 is interconnected with the corresponding horizontal strap 86, respectively. Preferably, two back straps 82 are in cross contact with each other as show in FIGS. 10 and 11. Optionally, a back buckle 92 can be used to assist in holding back straps 82 together.

In FIGS. 10 and 11, horizontal straps 86 are not connected to each other at the front, and they are directly extended into front extension 88. However, horizontal straps 86 can be connected to each other at the front, for example by a buckle, with front extensions 88 still extending out for connecting resilient retraction means 100.

Figure 12:
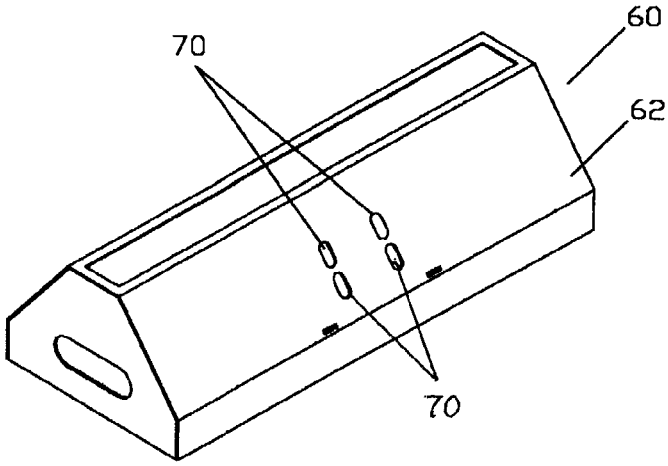
FIG. 12 is a perspective view of the footrest of the second embodiment of the present invention.
Figure 17:
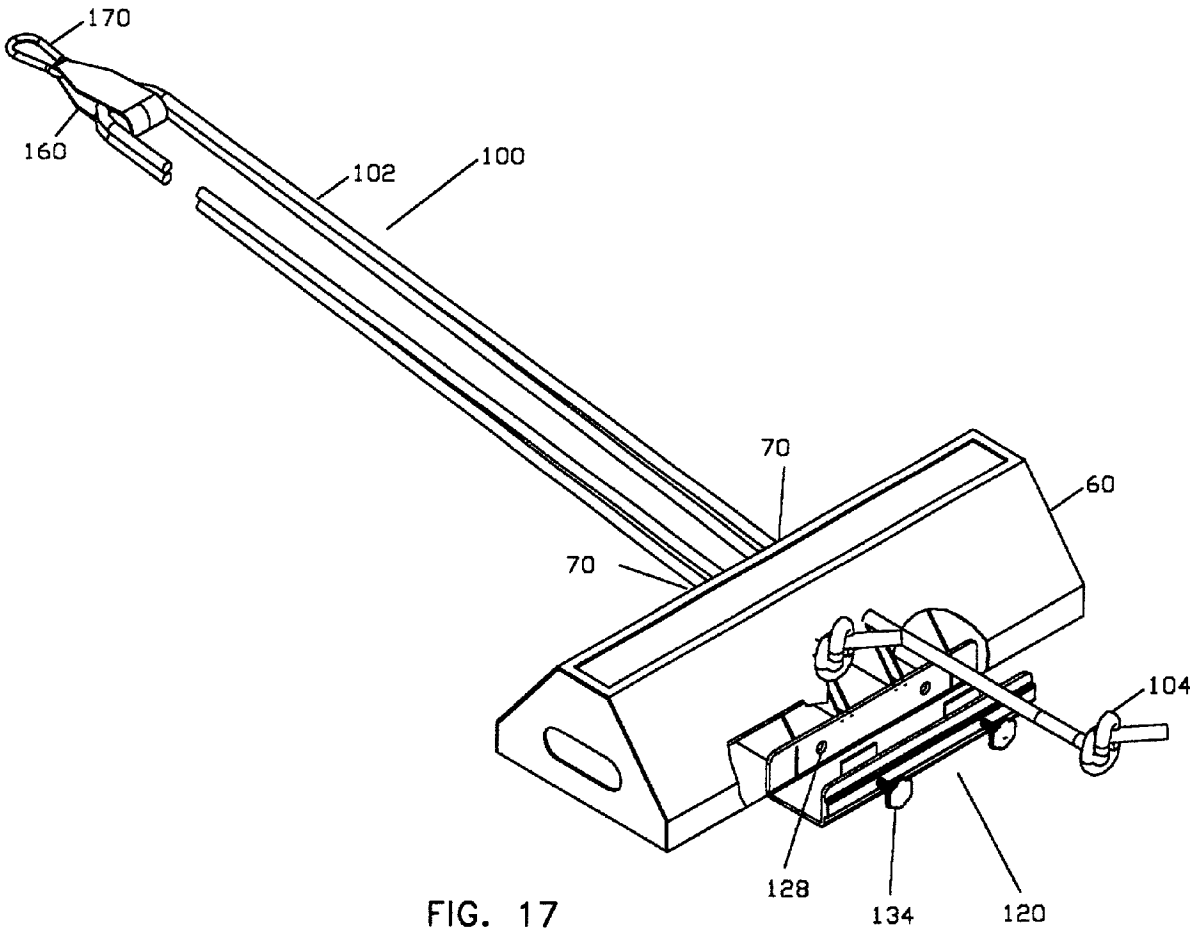
FIG. 17 is a partial exploded view of the retraction means, footrest and the anchoring means of the second embodiment of the present invention.

In the second embodiment, footrest 60 can have the same structure of the footrest of the first embodiment, additionally with one or more retraction opening 70 on one of sidewalls 62 for connecting resilient retraction means 100 to footrest 60, as shown in FIG. 12. The number of retraction opening 70 is determined by the types of resilient retraction means 100 used. If a single spring is used, the spring can be connected through one retraction opening 70 to footrest 60. In FIG. 12, there are four retraction openings 70, which are used for connecting four strings of bungee cord as illustrated in FIG. 17. It is apparent that footrest 60 shown in FIG. 12 can be utilized for either one person or two person sit-up exercise according to the present invention. However, if footrest 60 is only used to the one person sit-up exercise as illustrated by FIGS. 8A and 8B, the first and second sidewalls do not need to be the same. The sidewall anchored to a stationary support can be straight without inclined surface. Preferably, footrest 60 further includes one or more alignment knurl (not shown) on the interior and near the bottom of the sidewall that is attached to anchoring means 120. The alignment knurl further assists anchoring means 120 in preventing movement of footrest 60 during the exercise.

Figure 13:
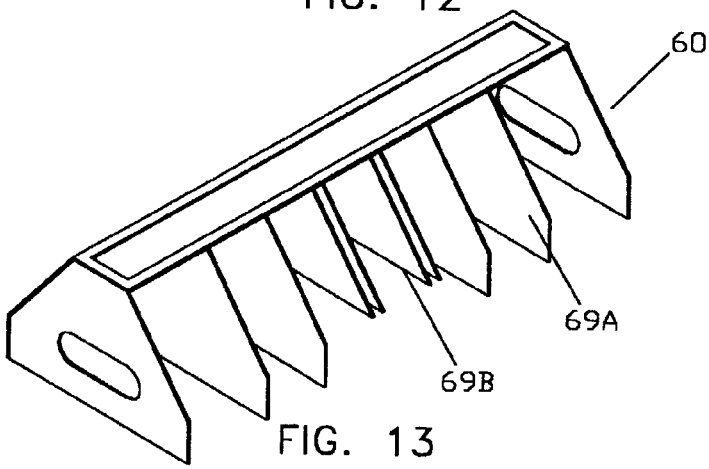
FIG. 13 is a partial cross sectional view of the footrest of the second embodiment of the present invention.

FIG. 13 shows multiple reinforcing ribs 69A and 69B between two sidewalls 60. It is noted that reinforcing ribs 69B at the center are shorter, which provides a space for storage of anchoring means 120 as shown hereinafter.

Figure 14:
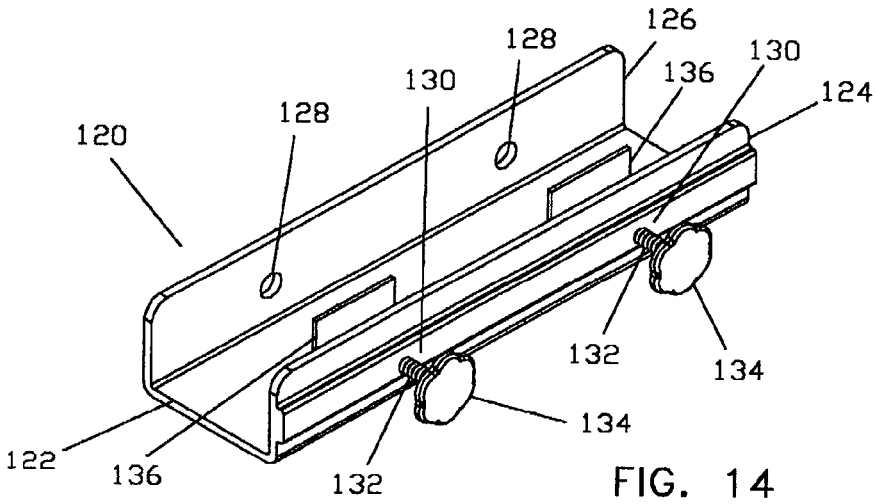
FIG. 14 is a perspective view of the anchoring means of the second embodiment of the present invention.
Figure 15:
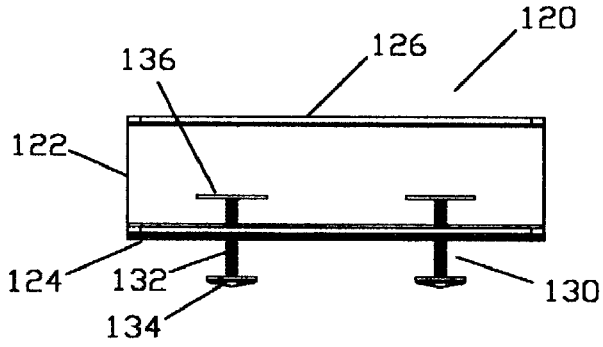
FIG. 15 is a top view of the anchoring means of the second embodiment of the present invention.

FIGS. 14 and 15 show an example of anchoring means 120. The anchoring means 120 includes a base 122 connected to a first and second anchoring plates 124 and 126, respectively, and one or more fasten means 130 connected to first anchoring plate 124. Preferably, anchoring means 120 further includes one or more alignment opening 128. Alignment opening 128 is adapted to alignment knurl of footrest 60 to prevent a vertical movement of footrest 60 during the exercise. The base 122 and anchoring plates 124 and 126 can be made of metal, plastic and other suitable materials.

Fasten means 130 can be a threaded rod 132 screwed into first anchoring plate 124 as shown in FIG. 14. Fasten means 130 further includes a knob 134 for the ease of hand operation, and an adjustable plate 136 for pressing onto stationary support 150. With anchoring means 120, footrest 60 can be conveniently anchored to a door, as shown in FIGS. 8A and 8B, or other suitable stationary objects.

Figure 16:
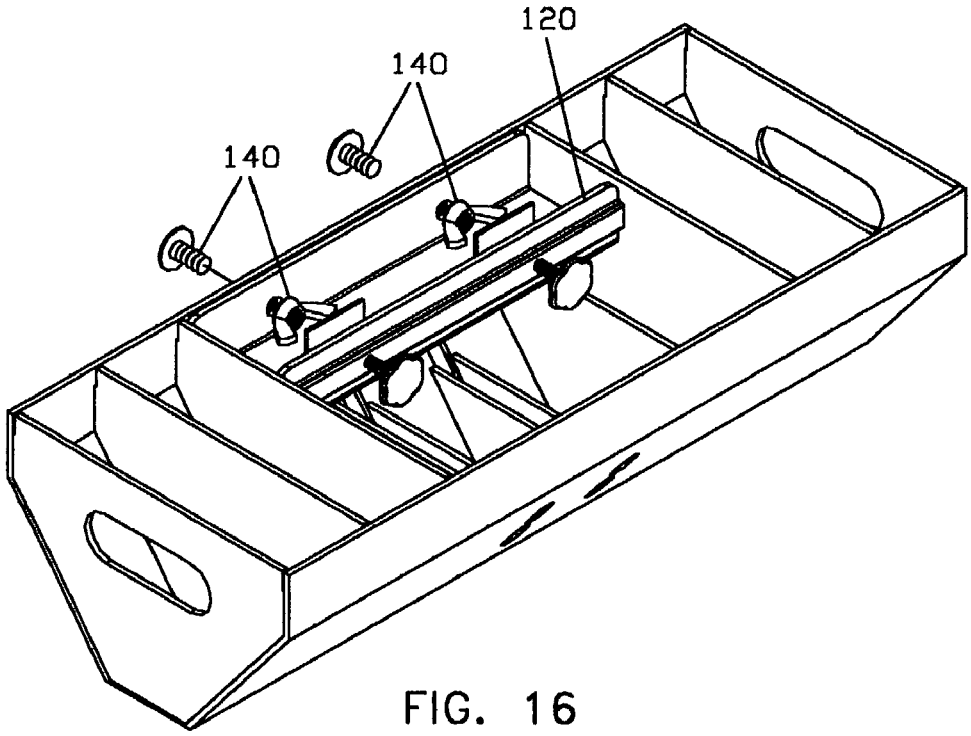
FIG. 16 is a bottom exploded view of the footrest showing the anchoring means stored inside the bottom portion of the footrest.

FIG. 16 shows a bottom view of footrest 60 with an anchoring means 120 stored inside for transportation and storage. As shown, anchoring means 120 can further include one or more attachment means 140 to secure anchoring means 120 to footrest 60 for storage.

In alternative embodiment, footrest 60 can include an anchoring means 120 as an integral part of the footrest. The anchoring means can be an extension molded together with footrest 60. In this case, second anchoring plate 126 described previously can be the bottom portion of one of the sidewalls of footrest 60.

As illustrated in FIG. 17, resilient retraction means 100 is connected to footrest through retraction opening 70. Resilient retraction means 100 can be made of various materials, such as bungee cord, spring, and rubber band. FIG. 17 shows a loop of double strand bungee cord 102, secured to footrest 60 by knot 104 at each end of bungee cord 102. Additional fasten means can also be used to further secure the bungee cord onto footrest 60.

In the example shown by FIG. 17, resilient retraction means 100 can be connected to retraction connection means 90 of harness 80 through a locking loop 170, which is attached to bungee cord 102 by a connector 160.

When in use as illustrated in FIGS. 8A and 8B, a person wears harness 80, connects harness 80 to resilient retraction means 100 which is connected to footrest 60 anchored against a stationary support 150, and seats on the floor with his feet up against inclined sidewalls 62. The exerciser alternates between a backward prone position and a sitting upright position for sit-up exercise. When the exerciser is at the backward prone position, resilient retraction means 100 helps to pull the exerciser's upper body up. With such assistance, those people who could not sit up by themselves now can do sit-up exercise. In the opposite movement, from the sitting upright position to backward prone position, with the resistance of resilient retraction means 100 the lying back movement can have support to the person's back, which can help to prevent back or muscle injuries commonly occurred during exercise.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A portable exercise apparatus comprising:

a hand-pulling device comprising a pair of handles connected by an adjustable connector, said handles being in perpendicular relation to a longitudinal axis of said adjustable connector; and a footrest having a pair of longitudinally disposed sidewalls for supporting feet of exercisers, said sidewalls projecting downwards and outward from a top which connects said sidewalls; and a pair of opposing endwalls, wherein said hand-pulling device is removably attached to said footrest for storage and transportation.

2. The portable exercise apparatus of claim 1, wherein each of said endwalls having an opening, and said hand-pulling device is removably attached to said footrest through one of said openings.

3. The portable exercise apparatus of claim 1, wherein said adjustable connector comprises a belt, and a belt length adjusting means connected to said belt.

4. The portable exercise apparatus of claim 1, wherein said adjustable connector comprises a plurality of linked loops.

5. A portable exercise apparatus comprising:

a footrest, a harness for a human upper body, a resilient retraction means connected between said footrest and said harness, an anchoring means for anchoring said footrest to a stationary support wherein said anchoring means comprises a base, a first and a second anchoring panel connected to two opposing aides of said base, and one or more fastening means attached to said first anchoring panel.

6. The portable exercise apparatus of claim 5, wherein said second anchoring panel of said anchoring means has one or more alignment opening for adapting to one or more alignment knurl of said footrest to prevent a vertical movement of said footrest.

7. The portable exercise apparatus of claim 5, wherein said footrest has a first and a second longitudinally disposed sidewalls for supporting feet of exercisers, and a pair of opposing endwalls; said first sidewall projecting downwards and outward from a top which connects said sidewalls, and said first sidewall having one or more retraction opening for connecting said resilient retraction means to said footrest.

8. The portable exercise apparatus of claim 7, wherein said footrest further comprises multiple reinforcing ribs between said sidewalls.

9. The portable exercise apparatus of claim 7, wherein said first and second sidewalls are different.

10. The portable exercise apparatus of claim 8, wherein said footrest further comprises an anchoring means for anchoring said footrest to a stationary support.

11. The portable exercise apparatus of claim 9, said anchoring means comprises a base with one side connected to a bottom of said second sidewall of said footrest, an anchoring panels connected to the opposing side of said base, and a fasten means attached to said anchoring panel.

12. The portable exercise apparatus of claim 5, wherein said harness has two back straps, each with an upper end extending to a front vertical strap and with a lower end connected to a horizontal strap; each said horizontal strap being connected to a front extension which is connected to a retraction connection means; and each of said front vertical straps being interconnected with one of said horizontal straps, respectively.

13. The portable exercise apparatus of claim 12, wherein said retraction connection means is one selected from the group consisting of loop, buckle means, locking ring, and other connection means.

14. The portable exercise apparatus of claim 12, wherein said back straps are in cross contact of each other.

15. The portable exercise apparatus of claim 12, wherein lengths of said front straps and horizontal straps can be adjusted.

16. The portable exercise apparatus of claim 12, wherein said front portions of horizontal straps are connected with each other.

17. The portable exercise apparatus of claim 5, wherein said resilient retraction means is made of a material selected from the group consisting of bungee cord, elastic string, spring, rubber band, and other elastic materials.

18. A method of physical exercise comprising: provide a portable exercise device including a foot rest, a harness for a human upper body, a resilient retraction means connected between said foot rest and said harness, an anchoring means for anchoring said foot rest to a stationary support, and; wherein said second anchoring means comprises a base, first and second anchoring panels connected to two opposing sides of said base, and one or more fastenings means attached to said first anchoring panel, and;

an anchoring said footrest to a solid support wearing said harness, and; placing an exercisers feet against said footrest, and alternating between a sitting upright position and a reclined backward position.

* * * * *